United States Patent [19]

Gartner

[11] Patent Number: 4,563,848

[45] Date of Patent: Jan. 14, 1986

[54] SECTION FOR BUILDING

[75] Inventor: Karl Gartner, Gundelfingen, Fed. Rep. of Germany

[73] Assignee: Yoshida Kogyo K.K., Tokyo, Japan

[21] Appl. No.: 519,194

[22] Filed: Aug. 1, 1983

[30] Foreign Application Priority Data

Aug. 2, 1982 [JP] Japan ..... 57-116167[U]

[51] Int. Cl.[4] ..... F04H 1/00

[52] U.S. Cl. ..... 52/235; 52/573; 49/DIG. 1

[58] Field of Search ..... 52/235, 777, 476, 781, 52/403, 573; 49/DIG. 1

[56] References Cited

U.S. PATENT DOCUMENTS 3,861,085 1/1975 Jacob ..... 49/DIG. 1 X
4,185,439 1/1980 Bischlipp et al. ..... 52/403 X
4,231,207 11/1980 Kern et al. ..... 49/DIG. 1 X
4,418,506 12/1983 Weber et al. ..... 52/235 X

FOREIGN PATENT DOCUMENTS 187533 2/1964 Sweden ..... 52/403

*Primary Examiner*—Carl D. Friedman
*Attorney, Agent, or Firm*—Hill, Van Santen, Steadman & Simpson

[57] ABSTRACT

A section for building used for vertical frame members and horizontal frame members for a curtain wall or a window sash. The section comprises a batten arranged so as to oppose to a mounting piece integrally formed on a short side wall on one side of a body and secured to the opposed surface of said mounting piece leaving a predetermined space, at least one connecting plate mounted between said batten and said mounting piece, and a connecting body disposed in the remaining space between said mounting piece and said batten in such a way that a space is left between said connecting plate and said connecting body.

6 Claims, 6 Drawing Figures

SECTION FOR BUILDING

BACKGROUND OF THE INVENTION

1. Field of the Invention

This invention relates to a section for building used for vertical frame members and horizontal frame members for a curtain wall or a window sash, and more particularly to a section for building in which a batten is connected to a section body.

2. Description of the Prior Art

In the past, the section for building of this kind known is a section in which a batten is connected to a section body through a heat insulating material. However, if the construction merely comprises an arrangement wherein the batten is connected to the section body through the heat insulating material, there involves inconveniences in that the mounting position of the batten is uneven, that the connecting strength is weak, and that sufficient heat insulating effect is not obtained.

SUMMARY OF THE INVENTION

The present invention has been made in view of the above-described circumstances, and it is an aspect of the invention to provide a section for building in which a batten may be positioned and mounted on a section body, and thereby the connecting strength may be increased, and further sufficient heat insulating effect may be obtained.

In order to achieve the above-described aspect, according to the present invention, there is provided a section for building which comprises a batten arranged so as to oppose to a mounting piece integrally formed on a short side wall on one side of a body and secured to the opposed surface of said mounting piece leaving a predetermined space, at least one connecting plate mounted between said batten and said mounting piece, and a connecting body disposed in the remaining space between said mounting piece and said batten in such a way that a space is left between said connecting plate and said connecting body.

According to the present invention, there is further provided a section for building wherein a plurality of said connecting plates are used, said connecting plates being inserted into a plurality of small recessed grooves formed in an external end surface of said mounting piece and into a plurality of small recessed grooves formed in an internal end surface of said batten, respectively.

According to the present invention, there is further provided a section for building wherein said batten is secured to said mounting piece by means of screws while said connecting body remains interposed.

According to the present invention, there is still further provided a section for building wherein said connecting plates and said connecting body are formed of a heat insulating material.

BRIEF DESCRIPTION OF THE DRAWINGS

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

An embodiment of the present invention will now be described with reference to the drawings.

Figure 1:
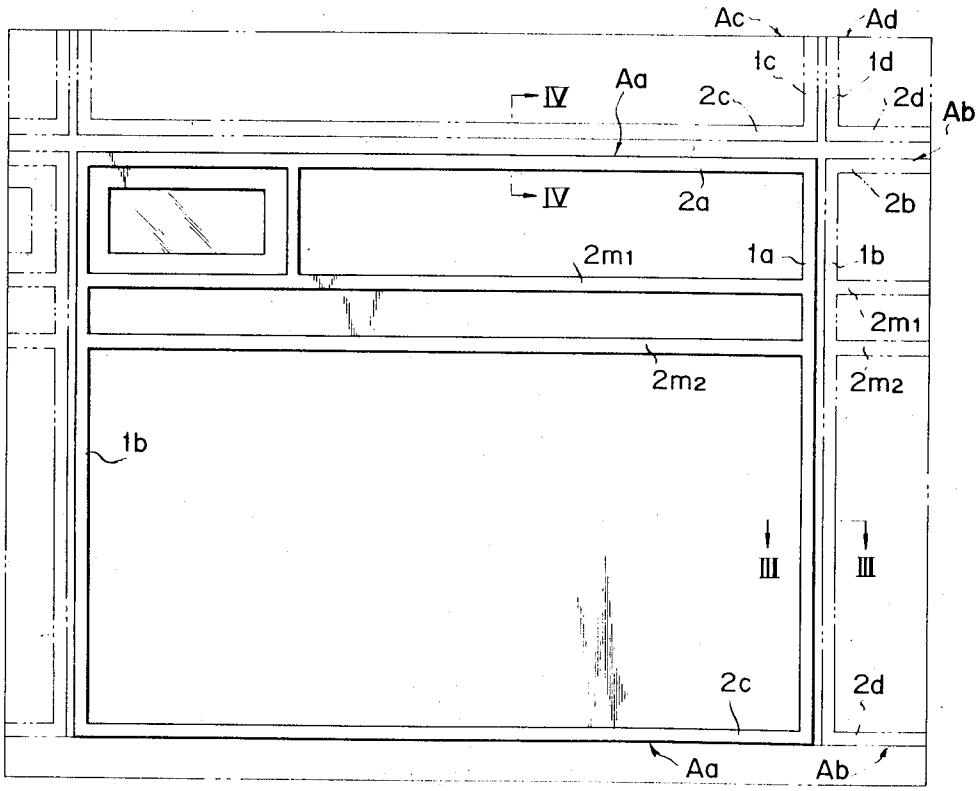
FIG. 1 is a front view showing a curtain wall.

FIG. 1 is a front view showing a curtain wall, which has a construction wherein curtain wall units Aa, Ab, Ac, Ad are mounted in plural number at top and bottom and left and right.

The curtain wall unit Aa has a shap in which a pair of vertical members 1*a*, 1*b*, an upper horizontal member 2*a*, a pair of intermediate horizontal members $2m_1$, $2m_2$ and a lower horizontal member 2*c* are connected in the form of a square frame.

Figure 2:
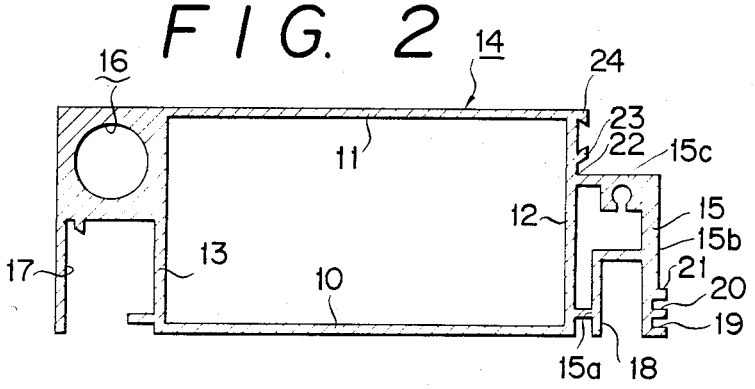
FIG. 2 is a sectional view of a section.

A section for constituting the vertical members 1*a*, 1*b* and the horizontal members 2*a*, $2m_1$, $2m_2$, 2*c* has a shape as shown in FIG. 2.

That is, a section body 14 in the form of a hollow lengthy member is composed of both long side walls 10, 11 and both short side walls 12, 13. One of the short side wall 12 is formed with a mounting piece 15, while the other short side 13 is formed with a longitudinally continuous hollow portion 16 and a recess 17 open towards the long side wall 10. The mounting piece 15 has one side wall 15*a* formed with a first mounting recess 18. An end wall 15*b* perpendicular to the side wall 15*a* is formed with second and third small mounting recesses 19, 20, the end wall 15*b* is formed with a shoulder 21. The other side wall 15*c* and the long side wall 12 of the section body 14 constitutes a shoulder 22. The short side wall 12 is integrally formed with a pair of locking projections 23 and 24.

Figure 3:
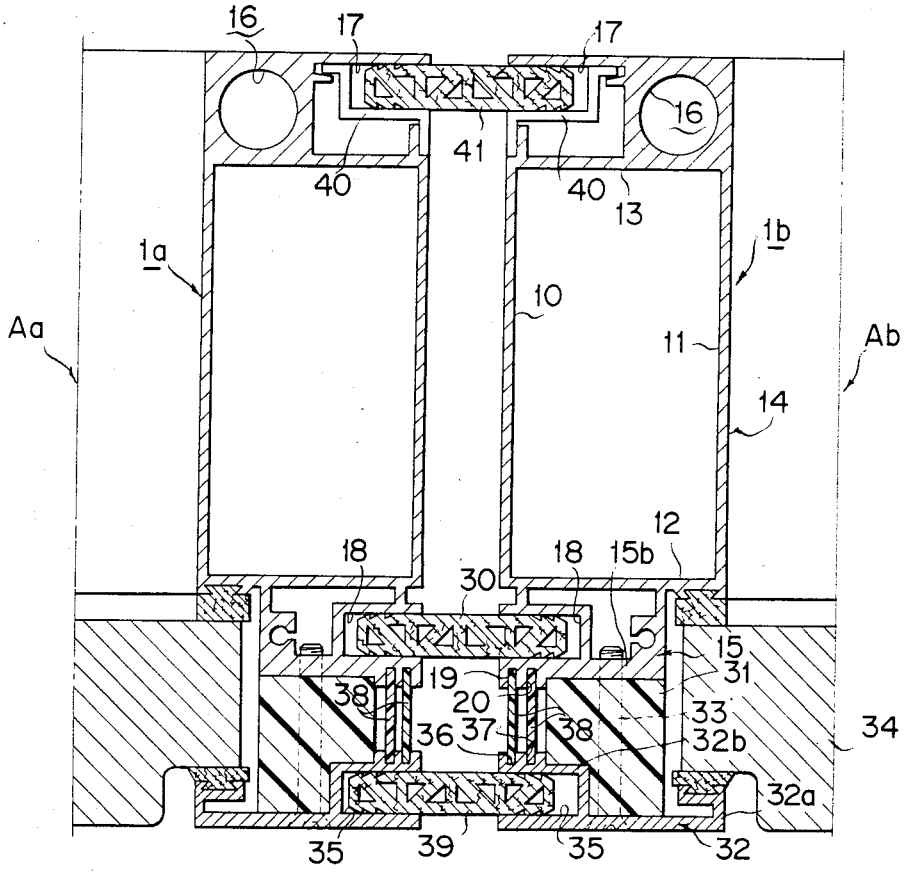
FIGS. 3 and 4 are sectional views taken on line III—III and line IV—IV, respectively, of FIG. 1.

In case of using as the vertical frame member, the section is mounted so that the side wall 10 is directed outwardly as shown in FIG. 3 which shows the vertical frame members 1*a*, 1*b* adjacent to left and right each other, and a seal material 30 such as a packing band is mounted between the first large mounting recesses 18, 18 of the vertical frame members 1, 1 of the unit curtain walls Aa, Ab adjacent to top and bottom and left and right to connect a pair of vertical frame members 1*a*, 1*b* in a lateral direction.

In FIG. 3, a vertical batten 32 is mounted on the end wall 15*b* in said mounting piece 15 by means of a screw 33 through a connecting member 31 formed of a heat insulating material, a panel 34 is held and mounted between an outer side wall 32*a* of the vertical batten 32 and the short side wall 12 of the vertical frame member 1*b*, the vertical batten 32 having the outer side wall 32*a* integrally formed with a bended wall 32*b* bended into a hook-shape to form a large recess 35, the bended wall 32*b* being formed with fourth and fifth small mounting recesses 36 and 37 opposed to the second and third small mounting recesses 19, 20 of the mounting piece 15, and a connecting plate 38, 38 formed of a heat insulating material is fitted in and mounted on the fourth and fifth small recesses 36, 37 and the second and third small mounting recesses 19 and 20, a seal material 39 such as a packing band is fitted and mounted between the large recesses 35, 35 of the vertical battens 32, 32 opposed to each other, and a seal material 41 such as a packing band is fitted and mounted between the large recesses 17 and 17 of the vertical frame members through a fitting 40.

With this arrangement, when the batten 32 is connected to the section body 14 through the connecting member 31, positioning is properly made by the connecting member 31, the connecting plate 38 and the recesses 19, 20, 36, 37 to provide an accurate connection at a required position and a layer of air shielded from outside can be formed between the connecting member 31 and the connecting plate 38 (that is, a space in which the connecting body 31 is not disposed is blocked by the connecting plate 38) to thereby prevent convection of air within the air layer to provide an excellent heat insulating effect.

A panel 34 is mounted between the outer side wall 32*a* of the batten 32 and the short side wall 12 of the body 14.

Figure 4:
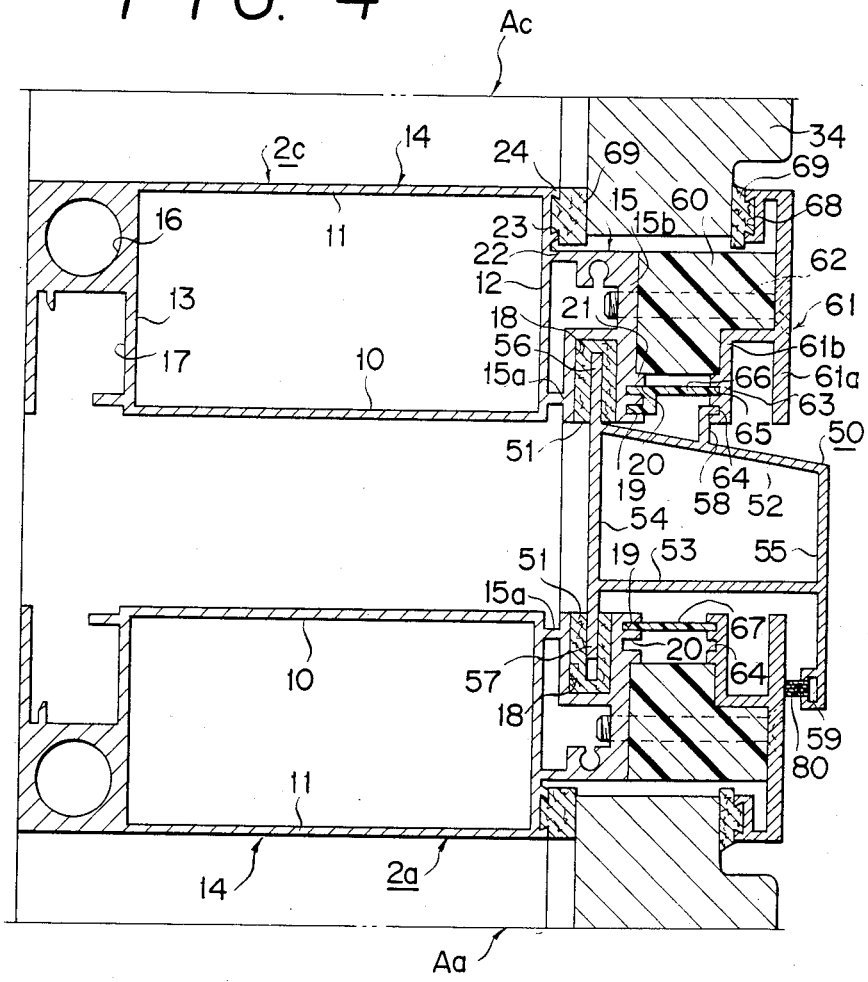

In case of using the section as the horizontal frame member, as shown in FIG. 4, the section as the upper horizontal frame member of the lower unit curtain wall unit is mounted so that the long side wall 10 thereof is directed upwardly whereas the lower horizontal frame member 2*c* of the upper unit curtain wall unit Ac is mounted so that the long side wall 10 thereof is directed downwardly, and upper and lower ends of a connecting member 50 are fitted in and mounted between the opposed first large mounting recesses 18, 18 through spacer members 51, 51.

That is, the connecting member 50 is provided with an upper wall 52, a lower wall 53, and inner and outer vertical walls 54, 55, the inner vertical wall 54 being continuously formed with a pair of upper and lower projections 56 and 57, the upper wall 52 being integrally formed with a hook 58, the outer vertical wall 55 extending downwardly and being formed at the end thereof with a recess 59, the upper and lower projections 56, 57 being mounted on the first large mounting recesses 18, 18 through the spacer members 51, 51. The hook 58 is fitted in and connected to the large recess 35, and a seal material 80 is fixed in the recess 59.

Further, a horizontal batten 61 is mounted by means of a screw bolt 62 on the end wall 15*b* of the mounting piece 15 of the section body 14 as an upper horizontal frame member by the interposition of a connecting member 60 made of a heat insulating material similarly as previously described. The horizontal batten 61 has an outer end wall 61*a* and a bended wall 61*b* integrally connected to and inwardly projected from the outer end wall 61*a*. In the bended wall 61*b* is formed sixth and seventh small mounting recesses 64 and 65 so as to be opposite to the second and the third small mounting recesses 19 and 20, respectively. Accordingly, an upper connecting plate 66 is fitted into and connected between the second and the third small mounting recesses 19 and 20 and the seventh small mounting recess 65 and, on the other hand, a lower connecting plate 67 is fitted into and connected between the second small mounting recess 19 and the sixth small mounting recess 64. In addition, the hook 58 of the connecting member 50 is fitted into the sixth small mounting recess 64 of the bended wall 61*b* of the upper horizontal frame member 2*c*. The end portion of the panel 34 is mounted and and held by the interposition of packings 69,69, which are mounted in a recessed groove 68 formed in the horizontal batten 61, between a pair of stopper pieces 23 and 24 integrally formed on the outer side of the short side wall 12 of the section body 14.

In such a construction as described above, in case of connecting the horizontal batten 61 to the section body 14 by the interposition of the connecting member 60, it is favourable to be able to make the positioning of curtain wall units precise so that the respective curtain wall units can be precisely mounted in position. Further, a hollow space which is closed independently of the outside such as, for example, atmosphere, is formed between the connecting member 60 and the connecting plate 66. Therefore, the prevention of air convection in thus formed hollow space brings an excellent heat insulating effect for the curtain wall units each of which includes the sections of the present invention as the vertical and the horizontal frame members thereof.

Figure 5:
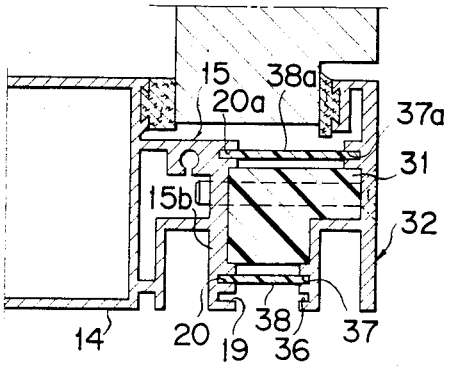
FIGS. 5 and 6 are respectively partial sectional views of another embodiments.
Figure 6:
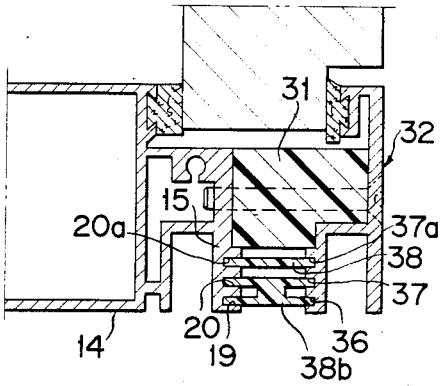

It should be understood that as shown in FIG. 5, recesses 19, 20, 20*a*, 36, 37, 37*a* can be formed above and below the connecting member 31 in the mounting piece 15 and the batten 32 so that the connecting plates 38, 38*a* may be mounted above and below the connecting member 31, and that as shown in FIG. 6, three recesses 19, 20, 20*a*, 36, 37, 37*a* can be formed in the mounting piece 15 and the batten 32 so that a plate-like connecting plate 38 and an H-shaped connecting plate 38*b* may be mounted.

It is further to be understood that the foregoing description is merely illustrative of the preferred embodiments of the present invention and that the scope of the invention is not to be limited thereto. Additional modifications or alterations of the invention will readily occur to one skilled in the art without departing from the scope of the invention.

What is claimed is:

1. A section for building used as vertical and horizontal members and mounted around a panel in the form of a square frame, the section comprising:

(a) a frame body;

(b) a batten disposed across from a mounting piece integrally formed on the outside facing side wall of said frame body and fixedly secured through a screw bolt (62) to the mounting piece so as to leave a predetermined space between the batten and the mounting piece;

(c) a relatively large connecting body formed of heat insulating material disposed in said space; and (d) at least one connecting plate substantially smaller than said connecting body disposed in said space between the batten and the mounting piece and fitted in small mounting recesses formed in an outside wall of said mounting piece and in an inside wall of said batten opposite to the outside wall of the mounting piece, said connecting plate being separated from said connecting body to block a hollow space fully between said connecting plate and said connecting body to prevent air convection within the layer of air adjacent said connecting body in said hollow space;

whereby said panel is mounted at one side of said space between the batten and the mounting piece and said connecting plate is mounted at the other side of said space relative to the interposition of said connecting body.

2. A section for building according to claim 1, wherein a plurality of said connecting plates are used, said connecting plates being inserted into a plurality of small recessed grooves formed in an external end surface of said mounting piece and into a plurality of small recessed groove formed in an internal end surface of said batten, respectively.

3. A section for building according to claim 2 wherein said plurality of connecting plates are provided on one side of said connecting body.

4. A section for building according to claim 2 wherein said plurality of connecting plates are provided on both sides of said connecting body.

5. A section for building according to claim 2 wherein at least two of said plurality of connecting plates are connected integral with each other.

6. A section for building according to claim 1, wherein said connecting plate is formed of a heat insulating material.

* * * * *